US005473107A

United States Patent [19]

Mizuno

[11] Patent Number: 5,473,107

[45] Date of Patent: Dec. 5, 1995

[54] ELECTRONIC MUSICAL INSTRUMENT CONTROLLING IMPARTMENT OR NON-IMPARTMENT OF EFFECT IN SYNCHRONIZATION WITH START OF TONE GENERATION

[75] Inventor: Kotaro Mizuno, Hamamatsu, Japan

[73] Assignee: Yamaha Corporation, Japan

[21] Appl. No.: 962,482

[22] Filed: Oct. 15, 1992

[30] Foreign Application Priority Data

Oct. 16, 1991 [JP] Japan ..... 3-267575
Aug. 7, 1992 [JP] Japan ..... 4-211343

[51] Int. Cl.[6] ..... G10H 7/00; G10H 1/06

[52] U.S. Cl. ..... 84/622; 84/626; 84/631; 84/662; 84/664

[58] Field of Search ..... 84/615, 622, 626, 84/631, 662, 664

[56] References Cited

U.S. PATENT DOCUMENTS 5,070,756 12/1991 Abe et al. ..... 84/618
5,119,710 6/1992 Mizuno ..... 84/615
5,260,508 11/1993 Bruti et al. ..... 84/622
5,281,756 1/1994 Kawashima ..... 84/615
5,300,729 4/1994 Tokunaga et al. ..... 84/657

*Primary Examiner*—William M. Shoop, Jr.
*Assistant Examiner*—Jeffrey W. Donels
*Attorney, Agent, or Firm*—Graham & James

[57] ABSTRACT

A selector is provided for selecting a predetermined effect. Instruction as to whether this effect should be imparted or not is not made instantly in response to an output of this selector but made in association with instruction of start of tone generation by a key-on event signal. For example, even when a state in which an effect is selected is brought about in the course of generation of a tone without selecting an effect, this effect is not imparted to the tone which is currently being generated. Upon instruction of generation of another new tone in this state, instruction of imparting of the effect is made for the new tone so that the effect is imparted to the new tone from the start of generation of the tone. Conversely, when a state in which no effect is selected is brought about in the course of generation of a tone which is imparted with an effect, the effect is kept imparted to the tone which is currently being generated until generation of the tone is ended.

17 Claims, 9 Drawing Sheets

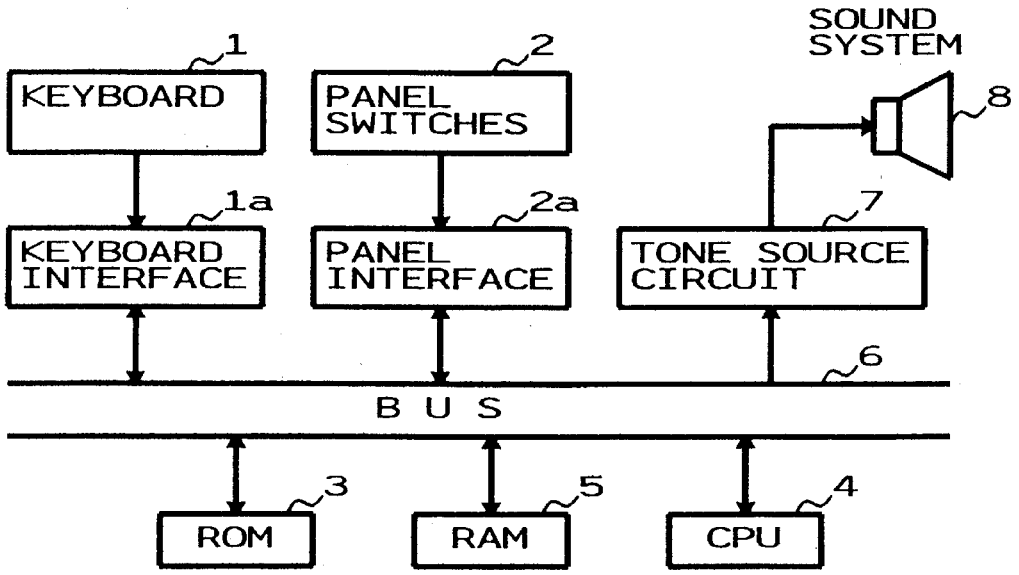
F I G. 1
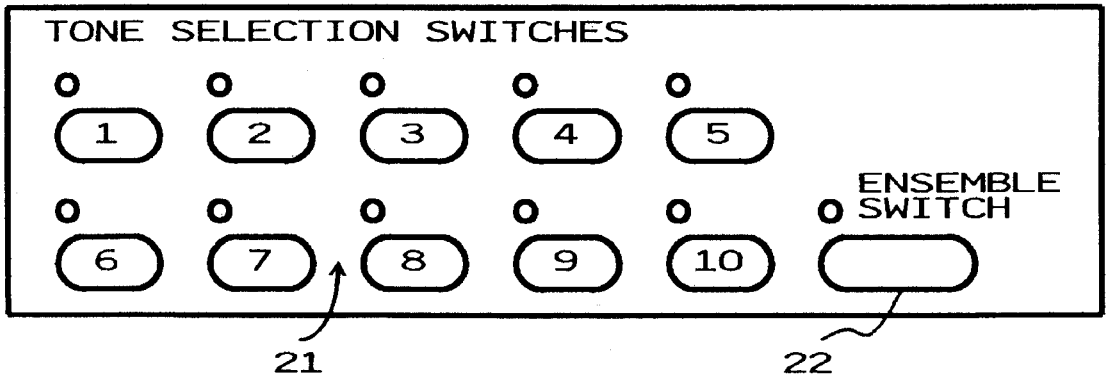
F I G. 2
| TIMBER NUMBER | TIMBER DATA GROUP 1 |
|---|---|
| TIMBER NUMBER | TIMBER DATA GROUP 2 |
| TIMBER NUMBER | TIMBER DATA GROUP 3 |
| ⋮ | ⋮ |
F I G. 3

| | |
|---|---|
| (TONE COLOR NUMBER)<br>TN=1 | THE NUMBER OF CHANNELS FOR "NORMAL"<br>THE NUMBER OF CHANNELS FOR "ENSEMBLE" |
| (TONE COLOR NUMBER)<br>TN=1 | TIM = Timber A<br>TIM = Timber B<br>TIM = Timber C<br>⋮<br>(TIMBER NUMBER) |
| Timber A Normol | Detune<br>Pan<br>Delay<br>AR |
| Timber B Normol | Detune<br>Pan<br>Delay<br>AR |
| Timber C Normol | Detune<br>Pan<br>Delay<br>AR |
| ⋮ | |
| Timber A Ensemble | Detune<br>Pan<br>Delay<br>AR |
| Timber B Ensemble | Detune<br>Pan<br>Delay<br>AR |
| Timber C Ensemble | Detune<br>Pan<br>Delay<br>AR |
| ⋮ | |
| (TONE COLOR NUMBER)<br>TN=2 | THE NUMBER OF CHANNELS FOR "NORMAL"<br>THE NUMBER OF CHANNELS FOR "ENSEMBLE" |
| | |

⋮

FIG. 8

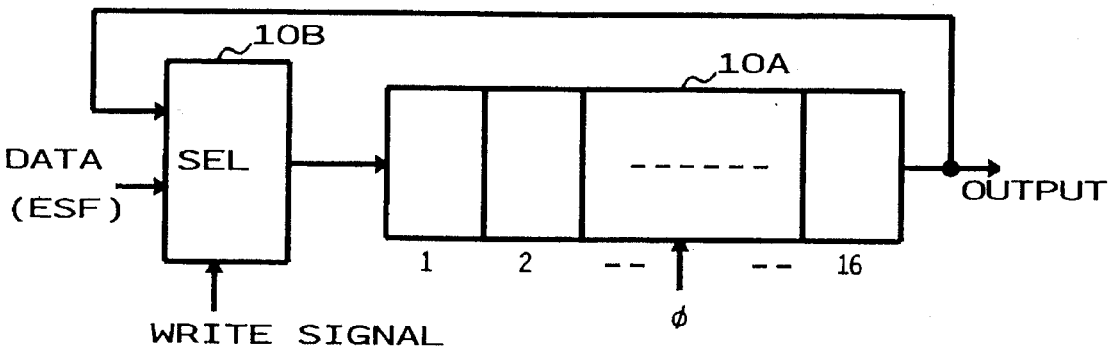
FIG. 11
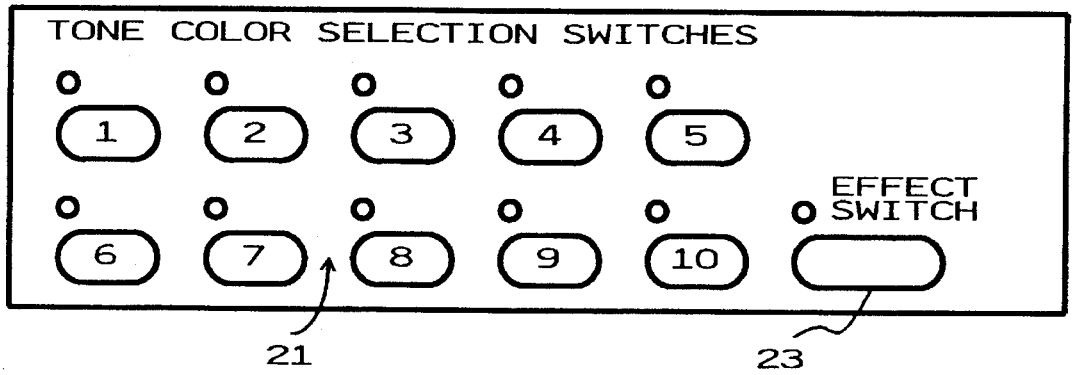
FIG. 12
| | |
|---|---|
| TN=1 | TIM=1 : EFF=b |
| | TMM=2 : EEF=c |
| TN=2 | TIM=1 : EFF=b&c |
| TN=3 | TIM=1 : EFF=b |
| | TIM=2 : EFF=b&c |
| ⋮ | ⋮ |
FIG. 16

ELECTRONIC MUSICAL INSTRUMENT CONTROLLING IMPARTMENT OR NON-IMPARTMENT OF EFFECT IN SYNCHRONIZATION WITH START OF TONE GENERATION

BACKGROUND OF THE INVENTION

This invention relates to an effect control in an electronic musical instrument capable of producing musical tones imparted with desired effects such as ensemble, reverberation, chorus, pitch change and delay and, more particularly, to an effect control in such electronic musical instrument capable of switching generation of a tone imparted with an effect and a normal tone.

Known in the art is an electronic musical instruments capable of imparting various effects as described above to musical tones to provide a variety to produced tones. In such electronic musical instrument, there is provided an effect selection switch for imparting a selected effect whereby a tone imparted with an effect and a normal tone which is not imparted with any effect are selectively generated by operation of this effect selection switch.

In the prior art electronic musical instrument, however, when this effect selection switch is turned on, a selected effect is imparted to a tone simultaneously with turning on of the switch. An abrupt change therefore occurs by this switch operation in a tone which has been sounded since before turning on of the switch with a result that the tone tends to become an unnatural tone. There is, for example, a processing for obtaining an ensemble effect according to which tones are produced in two or more lines and timing of panning in each of these lines is made different. When the effect selection switch is turned on during generation of tones in this case, a noise is generated due to the abrupt change in the panning.

In a case where the effect selection switch is operated during performance, for example when the performer who is performing the electronic musical instrument while watching a score wishes to impart an effect from the beginning of next bar in the score, the timing at which the switch is turned on must be coincidental with the beginning of the bar in the prior art musical instrument. In most cases, an operation for depressing a new key is necessary at the same timing as this timing and, therefore, the performer must perform two operations simultaneously. This requires a considerable skill which is too difficult for a beginner and is fairly troublesome even for a skilled performer with resulting difficulty in performance.

For producing an ensemble effect, for example, there is a processing called "key-on delay" applied to tones generated in two lines. This processing must be performed during key-on and, accordingly, it is not possible to adopt this processing in the prior art electronic musical instrument in which the ensemble effect is imparted simultaneously with turning on of an ensemble switch.

SUMMARY OF THE INVENTION

It is an object of the invention to improve operability in imparting effects to a tone by a switch operation in the course of performance by an electronic musical instrument thereby to reduce the burden of difficult switch operation imposed on the performer.

It is another object of the invention to prevent generation of a noise or an unnatural change in a tone when an effect selection switch is operated during generation of a tone.

It is still another object of the invention to produce an ensemble effect by using the key-on delay processing no matter when an effect selection switch is operated.

For achieving the objects of the invention, the electronic musical instrument according to the invention comprises tone generation instruction means for instructing that a tone should be generated, effect instruction means for instructing to impart a predetermined effect to the tone, tone generation means for generating a tone which is imparted, or not imparted, with the predetermined effect with respect to the tone for which generation is instructed by the tone generation instruction means, and control means for controlling said tone generation means in such a manner that the predetermined effect is imparted only to a particular tone for which generation is instructed to start, after it has been instructed by said effect instruction means that the predetermined effect should be imparted.

The control as to whether a predetermined effect should be imparted or not is made not immediately in response to the output of the effect instruction means but in association with the instruction for starting tone generation by the tone generation instruction means. Accordingly, even when, for example, impartment of the effect is instructed by the effect instruction means while a certain tone is being generated without inputting the effect, the effect is not imparted to the certain tone being generated. Thereafter, if generation of another new tone was designated, it is controlled in such a manner that the effect should be imparted to the new tone so that the effect is imparted from the beginning of generation of the new tone. Conversely, when a state where no effect is instructed is brought about by the effect instruction means while a certain tone is being generated with the effect being imparted to the tone, the instruction for not imparting the effect is not given to the tone being generated, so that the effect is kept to be imparted to the tone until generation of the tone is ended. Accordingly, imparting or releasing of an effect during generation of a tone is inhibited whereby occurrence of a noise is prevented. Moreover, since impartment of an effect to a tone is made in association with start of generation of the tone no matter when an effect instruction operation by the effect instruction means is made, it is not necessary to perform the effect instruction operation simultaneously with the key depression operation, so that operation of the electronic musical instrument is facilitated. Further, when an ensemble effect is to be imparted as a predetermined effect, the ensemble effect is always imparted from the beginning of generation of a tone and, therefore, impartment of the ensemble effect by the key-on delay is ensured. The invention is applicable not only to impartment of the ensemble effect but also to impartment of other effects including reverberation effect, echo effect, chorus effect, pitch change effect and delay effects.

Preferred embodiments of the invention will be described with reference to the accompanying drawings.

BRIEF DESCRIPTION OF THE DRAWINGS

In the accompanying drawings,

FIG. 1 is a block diagram of a hardware structure showing an embodiment of an electronic musical instrument according to the invention;

FIG. 2 is a diagram showing a part of a panel switch in this embodiment;

FIG. 3 is a diagram schematically showing a storage state of tone color data in this embodiment;

FIG. 8 is a diagram schematically showing another example of contents of parameters of tone color data;

FIG. 11 is a circuit diagram of an effect switch register in FIG. 10;

FIG. 12 is a diagram showing a part of a panel switch in FIG. 10;

FIG. 16 is a diagram schematically showing tone color parameters in the embodiment of FIG. 15.

DESCRIPTION OF PREFERRED EMBODIMENTS

Figure 4:
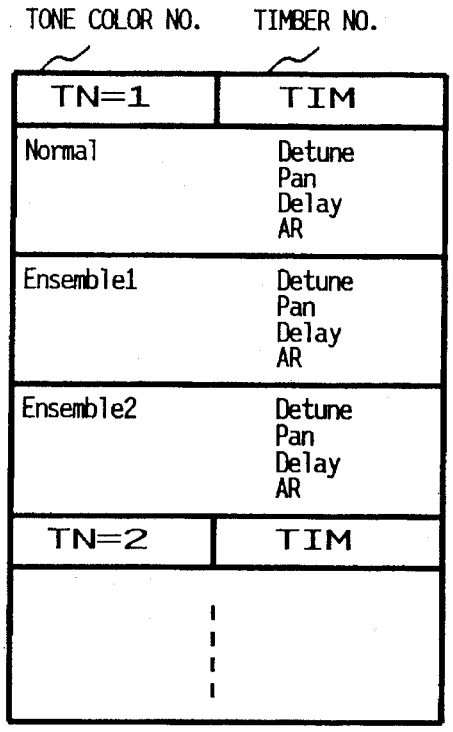
FIG. 4 is a diagram schematically showing an example of contents of parameters of tone color data of the embodiment.

In FIG. 1, a keyboard interface 1*a* detects depression of a key (key-on event) and release of a key (key-off event) by scanning a keyboard 1 and outputs a key code of a key in which one of these events has taken place.

A panel switch 2 includes, as shown in FIG. 2, tone color selection switches 21 for selecting a desired one of a plurality of tone colors, an ensemble switch 22 for selecting an ensemble effect and other unillustrated switches. A panel interface 2*a* detects an event by operation of each of these switches. When the ensemble effect is not selected by the ensemble switch 22, a normal tone which is not imparted with the ensemble effect (hereinafter referred to as "normal tone") is generated whereas when the ensemble effect is selected by the ensemble switch 22, a tone which is imparted with the ensemble effect (hereinafter referred to as "ensemble tone") is generated.

A ROM (read-only memory) 3 stores tone color data of plural lines, parameters for designating tone colors of normal tones and tone colors of ensemble tones and a control program to be described later. A CPU (central processing unit) 4 controls operations of the entire electronic musical instrument on the basis of the control program stored in the ROM 3 by using registers and other units established in a RAM (random access memory) 5. At this time, various information including key codes, key-on and key-off information, tone color data and parameters is exchanged through a bus 6.

A tone source circuit 7 is a tone source of a waveform memory reading type capable of simultaneously producing sixteen tones by a time division multiplexing processing. The tone source circuit 7 generates a digital waveform signal on the basis of tone color data, parameters, key codes, key-on signals etc. supplied from the CPU 2 through the bus 6 and supplies the waveform signal to a sound system 8 for sounding of a tone.

Tone color data stored in the ROM 3 is called "timber" and each timber group is, as shown schematically in FIG. 3, identified by a timber number TIM. A tone color selected by the tone color selection switch 21 is identified by a tone color number TN and tone color data of a timber data group is read out by a timber number TN designated by this tone color number TN.

In the first embodiment to be described below, one timber is used for each one type of tone color (i.e., tone color number). In the tone source circuit 7, a normal tone is generated in one channel by setting one set of parameters and ensemble tones are generated in two channels by setting two sets of parameters. In the second embodiment to be described later, plural timbers are used for one type of tone color (tone color number) and, in the tone source circuit 7, plural sets of parameters are respectively set for a normal tone and ensemble tones and both the normal tone and ensemble tones are generated in plural channels.

The first and second embodiments differ only in their control program and stored data such as parameters and, in both embodiments, a hardware of the electronic musical instrument is constructed with the circuit shown in FIG. 1.

FIG. 4 schematically shows contents of stored parameters in the first embodiment. In correspondence to each tone color number TN, timber number TIM, a set of parameters "Normal" for a normal tone, and two sets of parameters "Ensemble 1" and "Ensemble 2" for constituting ensemble tones are stored.

Each parameter consists of pitch data "Detune" for forming an ensemble tone by differring a pitch from another tone, panning data "Pan" for forming an ensemble tone by panning, data "Delay" for forming an ensemble tone by key-on delay and data"AR" i.e., "attack rate", concerning the rate of rising of a tone.

The parameters of "Detune", "Pan" and "Delay" concerning an ensemble tone are provided also for the parameter "Normal" of a normal tone. This is for facilitating the control by adopting the same format as the parameters of the ensemble tones ("Ensemble 1" and "Ensemble 2"). In this embodiment, the parameters of "Detune", "Pan" and "Delay" for the parameter "Normal" for the normal tone are normally set to "0".

Since it is effective to differ rising of an ensemble tone from rising of a normal tone for making rising of an ensemble tone more gradual than rising of a single tone, the parameters "AR" are set in this embodiment.

Figure 6:
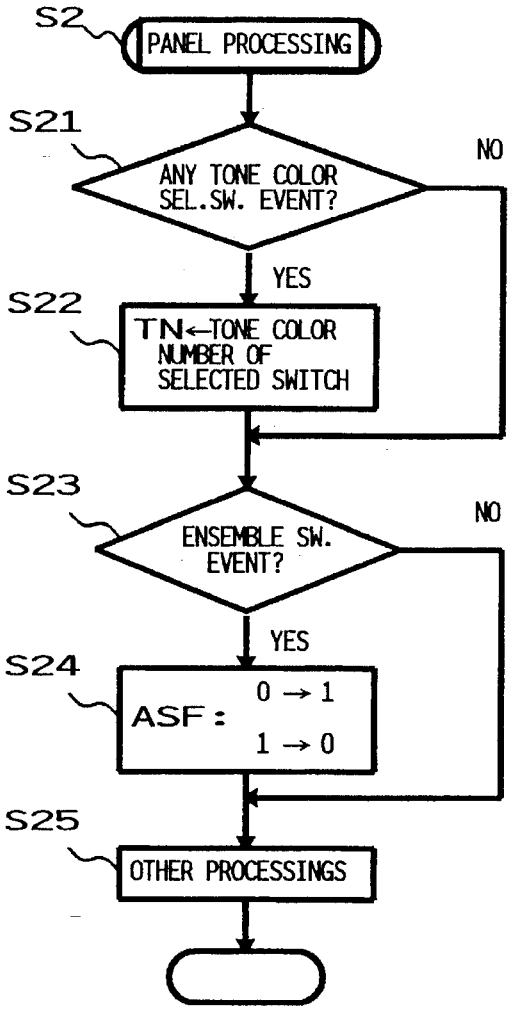
FIG. 6 is a flow chart of panel processing in the main routine.
Figure 5:
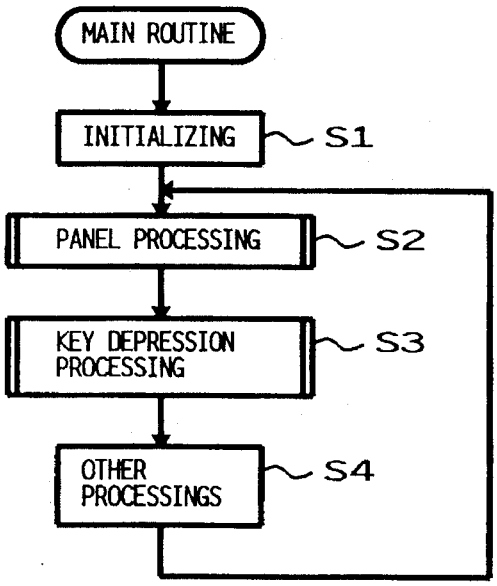
FIG. 5 is a flow chart of a main routine in the embodiment.
Figure 7:
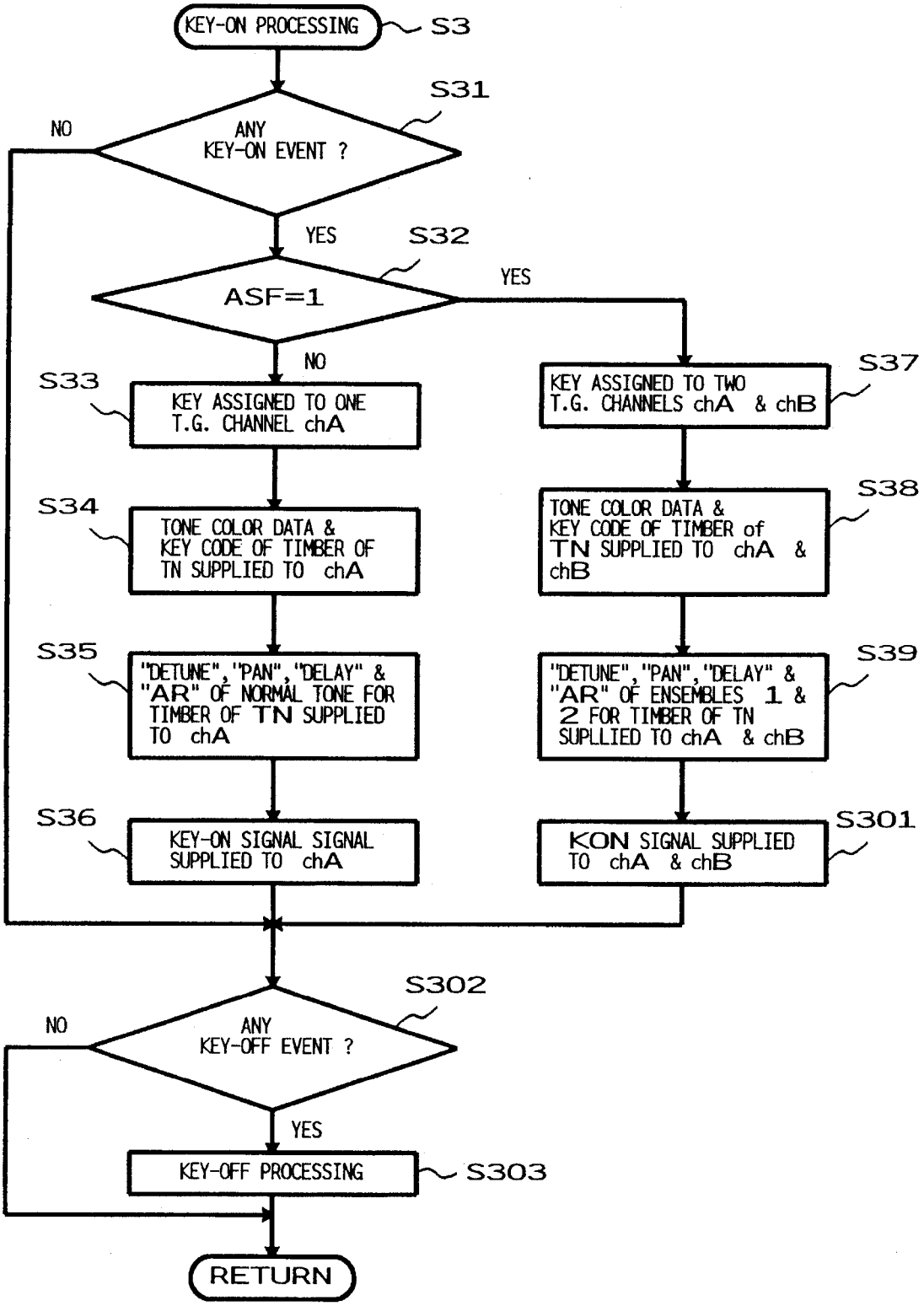
FIG. 7 is a flow chart showing an example of key depression processing in the main routine.

FIG. 5 is a flow chart showing a main routine of the control program, FIG. 6 a flow chart showing a subroutine of a panel processing and FIG. 7 a flow chart showing a subroutine of a key-on processing in the first embodiment.

First, upon turning on of a power, the CPU 1 starts processing of the main routine shown in FIG. 5. In step S1, initializing such as set-up of registers and flags is performed.

Then, the panel processing shown in FIG. 6 is executed in step S2, the key-on processing in step S3 and other processing in step S4 and then step S2 and subsequent steps are repeated.

In the panel processing S2 shown in FIG. 6, presence or absence of a switch event of the tone color selection switch 21 is detected in step S21. When there is no switch event, the routine proceeds directly to step S23. When there is a switch event, the tone color number of the operated switch is stored in a register TN and then the routine proceeds to step S23.

Then, in step S23, presence or absence of a switch event of the ensemble switch is detected. When there is no switch event, opther panel processing is executed in step S25 and the routine returns to the main routine.

When there is a switch event of the ensemble switch 22 in step S23, a flag ASF is inverted in step S24 to execute the processing of step S25 and then the routine returns to the main routine. When the flag ASF is "0", a normal tone is produced and when the flag ASF is "1", an ensemble tone is produced.

In the key-on processing shown in FIG. 7, presence or absence of a key-on event is detected. When there is no key-on, the routine proceeds to step S302. When there is a key-on event in step S31, whether the flag ASF is "1" or not is detected in step S32.

When the flag ASF is not "1" in step S32, processing of a normal tone is executed in steps S33 to S36 and thereafter the routine proceeds to step S302. When the flag ASF is "1", processing of an ensemble tone is executed in steps S37 to S301 and thereafter the routine proceeds to step S302.

In step S33, a processing for assigning a key relating to the key-on event to one of tone generation channels in the tone source circuit 7 is executed. It is assumed now that the one channel to which the key is assigned is called channel chA. In step S34, tone color data and key code of a timber of a tone color number TN which is stored in the ROM 3 and currently set are supplied to the channel chA of the tone source circuit 7.

Nextly, in step S35, parameters "Detune", "Pan", "Delay" and "AR" of a normal tone for the timber number TIM for the tone color number TN are read out and supplied to the channel chA of the tone source circuit 7. In step S36, a key-on signal KON is supplied to the channel chA of the tone source circuit 7 to generate a normal tone.

On the other hand, in step S37, a processing for assigning the key relating to the key-on event to any two tone generation channels in the tone source circuit 7 is executed. The two channels to which the key is assigned are called channels chA and chB. In step S38, tone color data and key code about the timber of the current tone color number TN stored in the ROM 3 are supplied to the channels chA and chB of the tone source circuit 7.

Then, in step S39, the parameters "Detune", "Pan", "Delay" and "AR" for the ensemble tones of "Ensemble 1" and "Ensemble 2" for the timber of the tone color TN are read out and supplied to the channels chA and chB of the tone source circuit 7. In step S301, the key-on signal KON is supplied to the channels chA and chB of the tone source circuit 7 for producing ensemble tones.

In step S302, presence or absence of a key-off event is detected. When there is no key-off event, the routine returns directly to the main routine. When there is a key-off event, a key-off processing is executed in step S303 and then the routine returns to the main routine.

FIG. 8 schematically shows contents of stored parameters of the second embodiment. In correspondence to each tone color number TN, the number of lines of timber constituting a normal tone, the number of lines of timber constituting ensemble tones, timber number TIM for each line, parameters for each line of the normal tone ("Timber A NOrmal", "Timber B Normal", "Timber C Normal" etc.) and parameters for each line of the ensemble tones ("Timber A Ensemble", "Timber B Ensemble", "Timber C Ensemble" etc.) are respectively stored.

Each parameter consists, as in the first embodiment, of pitch data "Detune", panning data "Pan", key-on delay data "Delay" and attack rate "AR". In this embodiment, a normal tone is constructed of timbers of plural lines and each parameter "Normal" for the normal tone is set in accordance with the tone color of the generated tone.

Figure 9:
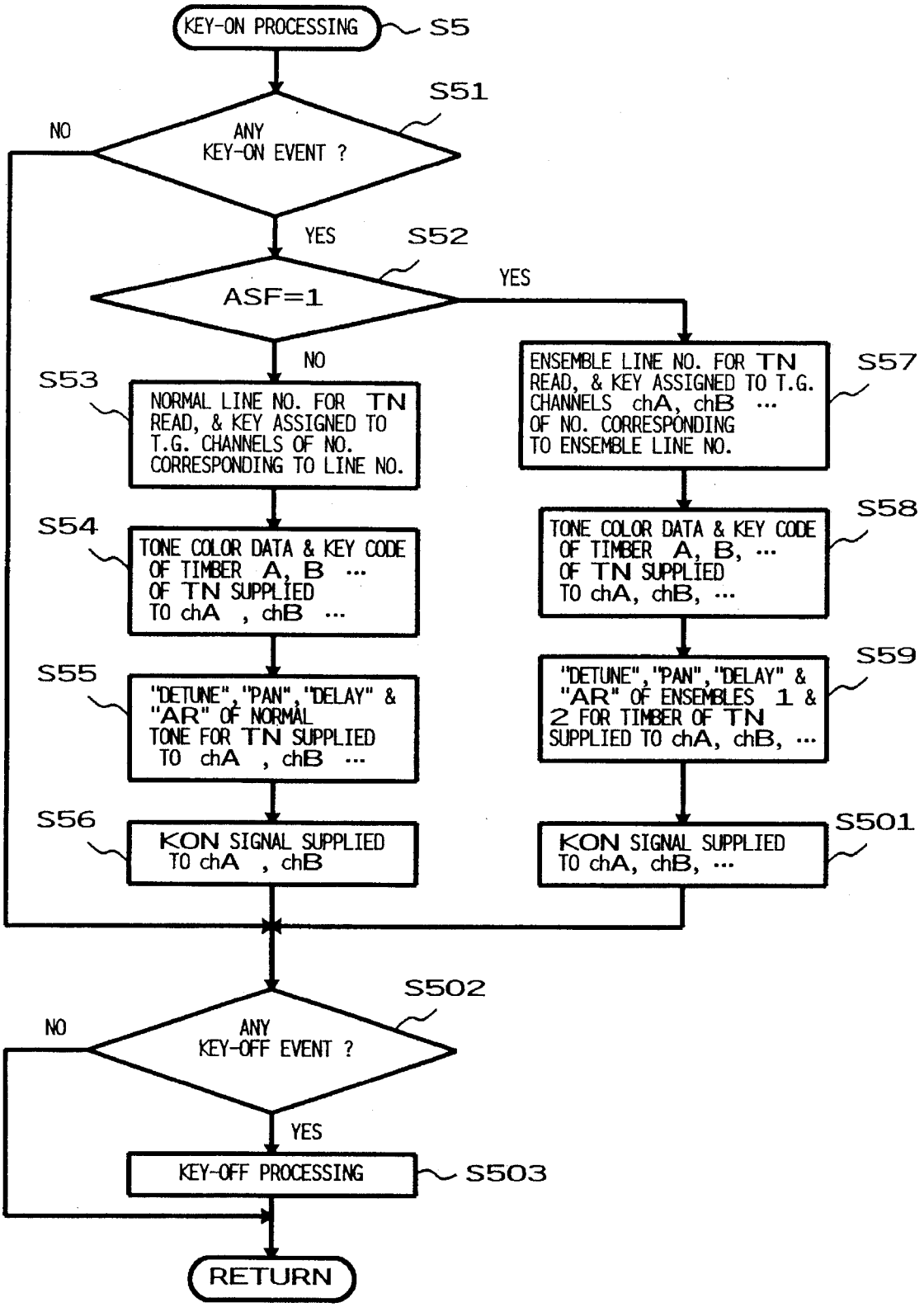
FIG. 9 is a flow chart showing another example of key depression processing in the main routine.

FIG. 9 is a flow chart showing a subroutine of a key-on processing in the second embodiment which corresponds to step S3 in FIG. 5.

In the key-on processing shown in FIG. 9, presence or absence of a key-on event is detected in step S51. When there is no key-on, the routine proceeds to step S502. When there is a key-on event in step S51, whether the flag ASF is "1" or not is detected in step S52.

When the flag ASF is not "1", a processing of a normal tone is executed in steps S53 to S56 and then the routine proceeds to step S502. When the flag ASF is "1", a processing of an ensemble tone is executed in steps S57 to S501 and then the routine proceeds to step S502.

In step S53, the number of lines for the tone color number TN is read and key relating to the key-on event is assigned to tone generation channels of the number corresponding to the number of lines. The channels to which the key is assigned are designated by chA, chB, . . . respectively. In step S54, tone color data is read from the timber number TMN of the respective lines of the tone color number TN and this tone color data and the key code are supplied to the channels chA, chB etc. of the tone source circuit 7.

Then, in step S55, the parameters "Detune", "Pan", "Delay" and "AR" of the normal tone for the timber numbers of the respective lines for the tone color number TN are read out and supplied to the channels chA, chB etc. of the tone source circuit 7. In step S56, the key-on signal KON is supplied to the channels chA, chB etc. of the tone source circuit 7 for performing generation of a normal tone.

On the other hand, in step S57, the number of lines of the ensemble tones for the tone color number TN is read and the key relating to the key-on event is assigned to tone generation channels of the number corresponding to the number of the lines. The channels to which the key is assigned are designated by chA, chB etc. In step S58, tone color data is read from the timber numbers TIM of the respective lines for the tone color number TN and this tone color data and the key code are supplied to the channels chA, chB etc. of the tone source circuit 7.

Then, in step S59, the parameters "Detune", "Pan", "Delay" and "AR" of the ensemble tones of the respective lines for the tone color number TN are read out and supplied to the channels chA, chB etc. of the tone source circuit 7. In step S501, the key-on signal KON is supplied to the channels chA, chB etc. of the tone source circuit 7 for performing generation of ensemble tones.

Upon completion of the above processing, presence or absence of a key-off event is detected in step S502. When there is no key-off event, the routine returns directly to the main routine. When there is a key-off event, a key-off processing is executed in step S503 and then the routine returns to the main routine.

As described above, in the above described embodiments, presence or absence of designation of an ensemble tone is stored in the flag ASF by operation of the ensemble switch 22 and, when there is a key-on event, switching to an ensemble tone about a newly generated tone is performed by this key-on. Accordingly, an abrupt change of a normal tone which has already been generated to an ensemble tone during generation of the normal tone does not take place and, therefore, no noise due to change in panning is generated.

Moreover, since the ensemble tone is generated only for a key-on event made after operation of the ensemble switch, it is possible, in a case where it is desired to change the performance to an ensemble performance at the beginning of a next bar, to operate the ensemble switch in advance of a key depression operation which is made at the beginning of the bar. Thus, operation of the electronic musical instrument is facilitated and difficulty in the performance can be avoided.

Further, since the switching to the ensemble tone is made by a key-on event, the ensemble effect by the key-on delay can be imparted without any problem.

In the above described embodiment, there are only four types of parameters "Detune", "Pan", "Delay" and "AR" which are changed when the ensemble switch is operated. There may be more parameters. For example, not only "AR", but all parameters for the entire amplitude envelope may be used. Further, for the ensemble effect, the parameters of the same tone color are often changed as in the first embodiment. Alternatively, a tone of a line which is increased for the ensemble effect may be of a different tone color (tone waveform).

Figure 10:
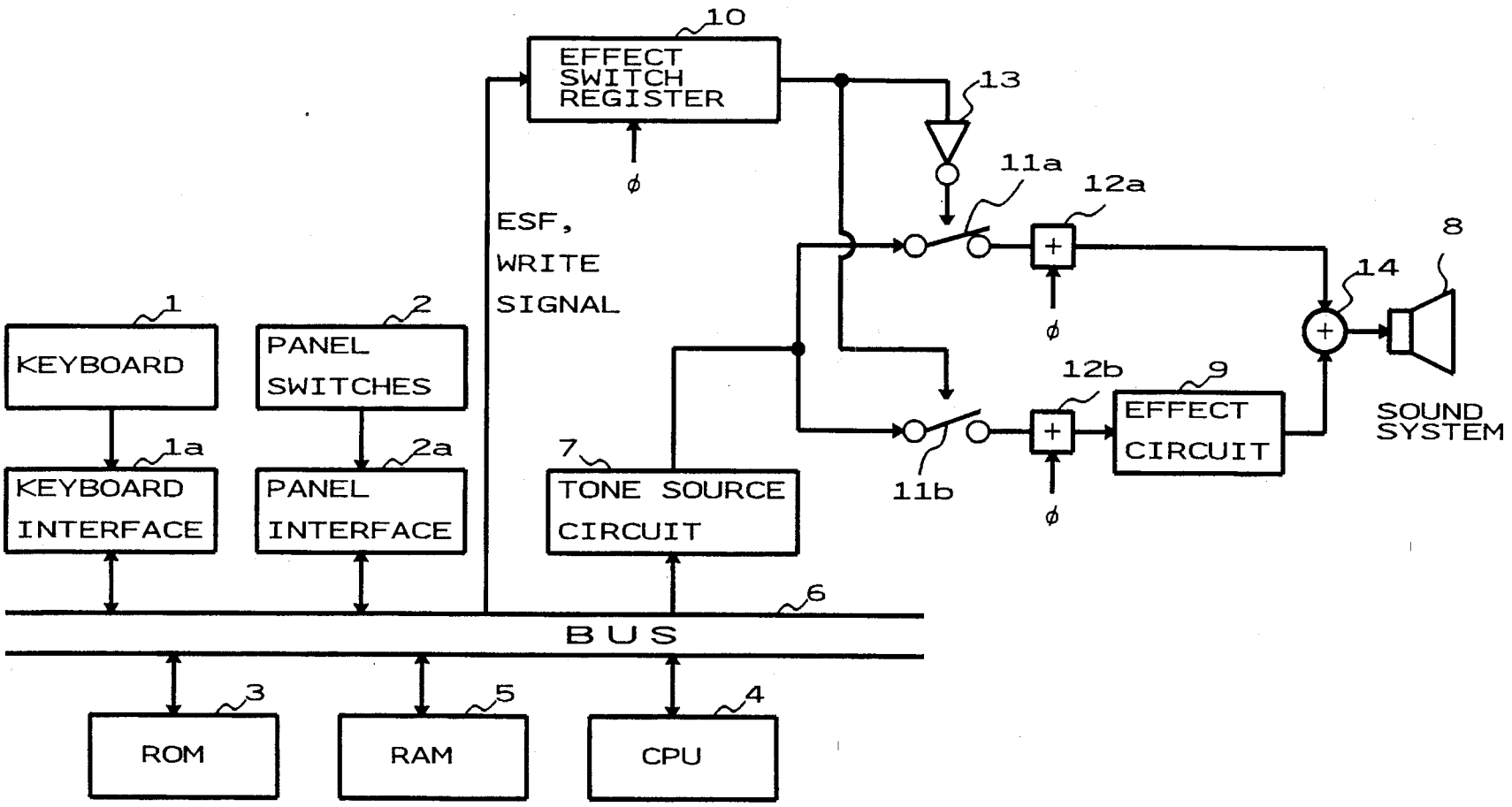
FIG. 10 is a block diagram of a hardware structure of another embodiment of the electronic musical instrument according to the invention.

FIG. 10 is a block diagram of a third embodiment of the electronic musical instrument according to the invention. In this figure, the same elements as those in FIG. 1 are designated by the same reference characters. In the first and second embodiments, a predetermined effect (e.g., an ensemble effect) is imparted in accordance with data established in the tone source circuit 7, whereas in this third embodiment, a selected effect among effects such as reverberation, chorus, pitch change and delay is imparted to a tone signal of a normal tone produced by a tone source circuit 7 by an effect circuit 9. Selection of an effect is made by an unillustrated switch in a panel switch 2.

The effect circuit 9 is constructed of a so-called digital signal processor which loads a program corresponding to a predetermined effect selected by the panel switch 2 from an unillustrated memory and imparts the effect by applying an arithmethic operation to a tone signal from the tone source circuit 7 in accordance with the loaded program. Alternatively, the effect circuit 9 may be a circuit which imparts a specific effect.

The panel switch 2 includes, as shown in FIG. 12, tone selection switches 21 which are similar to those in the above described embodiments and an effect switch 23 for performing switching between a state in which a tone is imparted with an effect and a state in which a tone is not imparted with an effect. The state of operation of the effect switch 23 is stored in a flag ESF. More specifically, when an effect is imparted, the flag ESF is "1" and when an effect is not impart, the flag ESF is "0". The tone source circuit 7 generates, in the same manner as the one in the above described embodiments, a tone in accordance with tone color data of a timber corresponding to a tone color number TN selected by a tone color selection switch 21.

An effect switch register 10 includes, as shown in FIG. 11, a shift register 10A consisting of bits (16 bits) corresponding in number to the number of channels in the tone source circuit 7 and a selector 10B which selects input data to the shift register 10A. In the shift register 10A, a value of the flag ESF (one bit data) at a time point when a tone generation channel in the tone source circuit 7 is assigned, i.e., when a key-on evnet occurs, is stored in correspondence to the particular channel.

The shift regfister 10A performs a shifting operation in synchronism with a clock $\phi$ of a time division operation in the tone source circuit 7 and, when a write signal from a CPU 4 to the selector 10B is disabled, shifts respective bits circulatingly and sequentially outputs the value of the flag ESF corresponding to each channel of the tone source circuit 7 as a one-bit signal.

Relation between each one-bit data which is shifted in the shift register 10A and each channel in the tone source circuit 7 is so established that an output bit of the shift register 10A corresponds to an output channel in the tone source circuit 7 of the same time slot. When the CPU 4 writes a value of the flag ESF in the selector 10B, it outputs a write signal to the selector 10B when data is applied to the shift register 10A at a time slot corresponding to the assigned tone generation channel.

On the other hand, the output of the tone soruce circuit 7 is applied to accumulators 12*a* and 12*b* through switches 11*a* and 11*b*. The output of the accumulator 12*a* is applied to one input terminal of an addition circuit 14. The output of the accumulator 12*b* is applied to the effect circuit 9. The output of the effect circuit 9 in turn is applied to the other input terminal of the addition circuit 14. The output of the addition circuit 14 is supplied to a sound system 8.

The switches 11*a* and 11*b* are opened and closed in opposite way by an output bit of the effect siwtch register 10. More specifically, one switch 11*b* is opened and closed by the output bit of the effect switch register 10 and the other switch 11*b* is opened and closed by a signal obtained by inverting the output bit of the effect switch register 10 by an inverter 13. When the output bit is "0", the switch 11*a* is "closed" and the switch 11*b* is "opened" whereas when the ouptut bit is "1", the switch 11*a* is "opened" and the switch 11*b* is "closed".

The accumulators 12*a* and 12*b* which are operated in synchronism with the clock $\phi$ and add data of the respective channels which are time division outputs of the tone source circuit 7 and output sum values upon completion of addition for 16 channels.

According to the above described structure, a tone signal of a channel whose corresponding flag ESF is "0" among respective output channels of the tone source circut 7 is accumulated in the accumulator 12*a* and a tone signal of a channel whose corresponding flag ESF is "1" is accumulated in the accumulator 12*b*. An effect is imparted to the tone signal added in the accumulator 12*b* by the effect circuit 9 and this signal is added to the tone accumulated tone signal of the accumulator 12*a* by an addition circuit 14 and the sum signal is supplied to the sound system.

Since the channel whose flag is "1" represents a case where the effect switch 23 has already been operated on the side of designating an effect at a time point when this channel is assigned as a tone generation channel, i.e., at a key-on event, the effect is imparted to a tone accumulated by the accumulator 12*b*. Conversely, since the channel whose flag is "0" represents a case where the effect switch 23 has already been operated on the side of not designating an effect at a key-on event, a tone signal accumulated in the accumultor 12*a* is supplied directly to the adder 14 even if there is a tone which is imparted with an effect in another channel.

Figure 13:
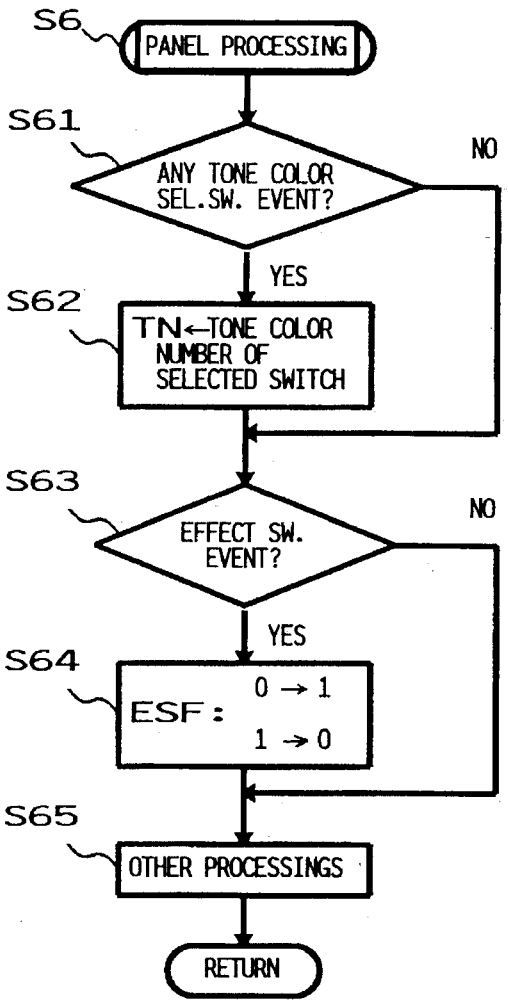
FIG. 13 is a flow chart of the panel processing in the embodiment of FIG. 10.
Figure 14:
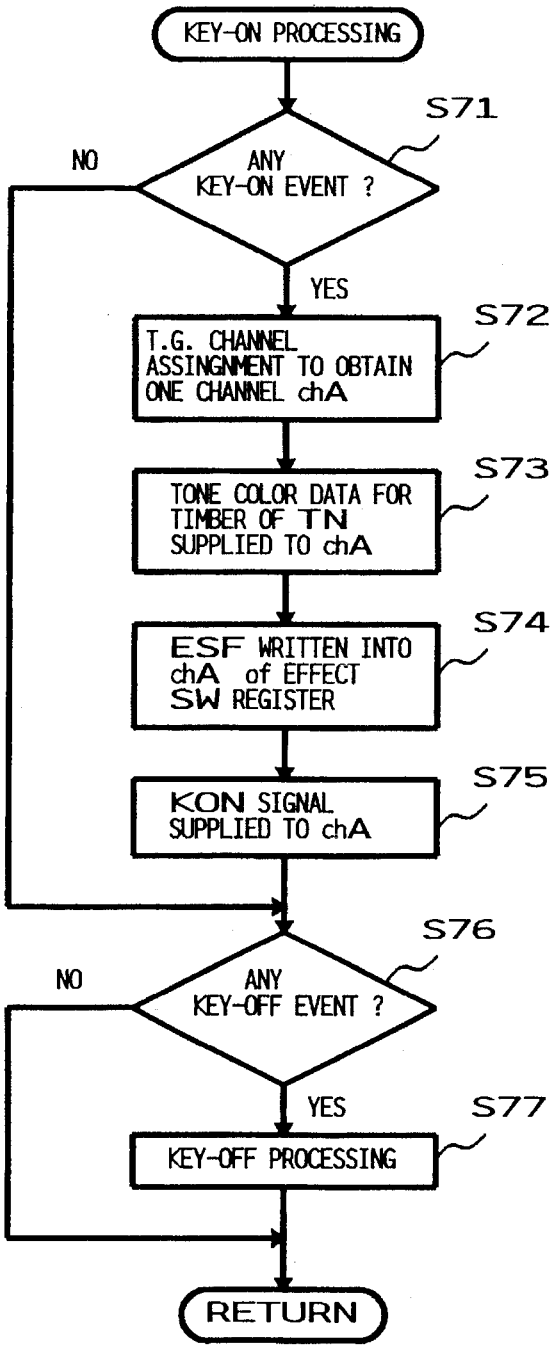
FIG. 14 is a flow chart of a key depression processing in the embodiment of FIG. 10.

FIG. 13 is a flow chart showing a panel processing in the third embodiment and FIG. 14 is a flow chart showing a key depression processing in the third embodiment. Since these processings are started by the same main routine as that in FIG. 5, description about the main routine will be omitted.

In the panel processing of FIG. 13, presence or absence of a switch event in the tone color selection switch 21 is detected in step S61. When there is no switch event, the routine proceeds directly to step S63 whereas when there is a switch event, the tone color number of the switch operated in step S62 is stored in the register TN and the routine proceeds to step S63.

Then, in step S63, presence or absence of a switch event of the effect switch 23 is detected. When there is no switch event, other panel processing is executed in step S65 and the routine returns to the main routine.

When there is a switch event of the effect switch 23 in step S63, the flag ESF is inverted in step S64 and the processing of step S65 is executed. Thereafter, the routine returns to the main routine.

In the key depression processing of FIG. 14, presence or absence of a key-on event is detected in step S71. When there is no key-on event, the routine proceeds to step S76. When there is a key-on event in step S71, assignment of a tone generation channel in the tone source circuit 7 is executed in step S72 to obtain one channel chA and tone color data about a timber of a tone color number TN which is currently set and a key code are supplied to the channel chA of the tone source circuit 7.

In next step S74, the current flag ESF is written in the shift register 10A of the effect switch 10 at a time slot corresponding to the channel chA and, in step S75, a key-on signal KON is supplied to the channel chA of the tone source circuit 7.

Upon completion of the above processings, presence or absence of a key-off event is detected in step S76. When there is no key-off event, the routine returns to the main routine. When there is a key-off event, a key-off processing is executed in step S77 and then the routine returns to the main routine.

As described above, in the third embodiment, the tone source circuit generates a normal tone signal when there is a key-on event but a tone signal generated at a key-on evnet subsequent to operation of an effect switch for designating imparting of an effect becomes a tone imparted with an effect by an effect circuit. On the other hand, a tone signal which is generated at a key-on event prior to operation of the effect switch remains to be a normal tone without being processed through the effect circuit, even if the effect switch is operated during generation of the tone signal. Accordingly, an abrupt change in a tone which is being generated will be prevented.

Since an effect is imparted to a tone only in a case of a key-on event subsequent to operation of the effect switch, the effect switch can be operated before a time point at which the effect should be imparted in the same manner as in the first and second embodiments, so that operation of the electronic musical instrument will be facilitated and difficulty in performance will be eliminated.

Figure 15:
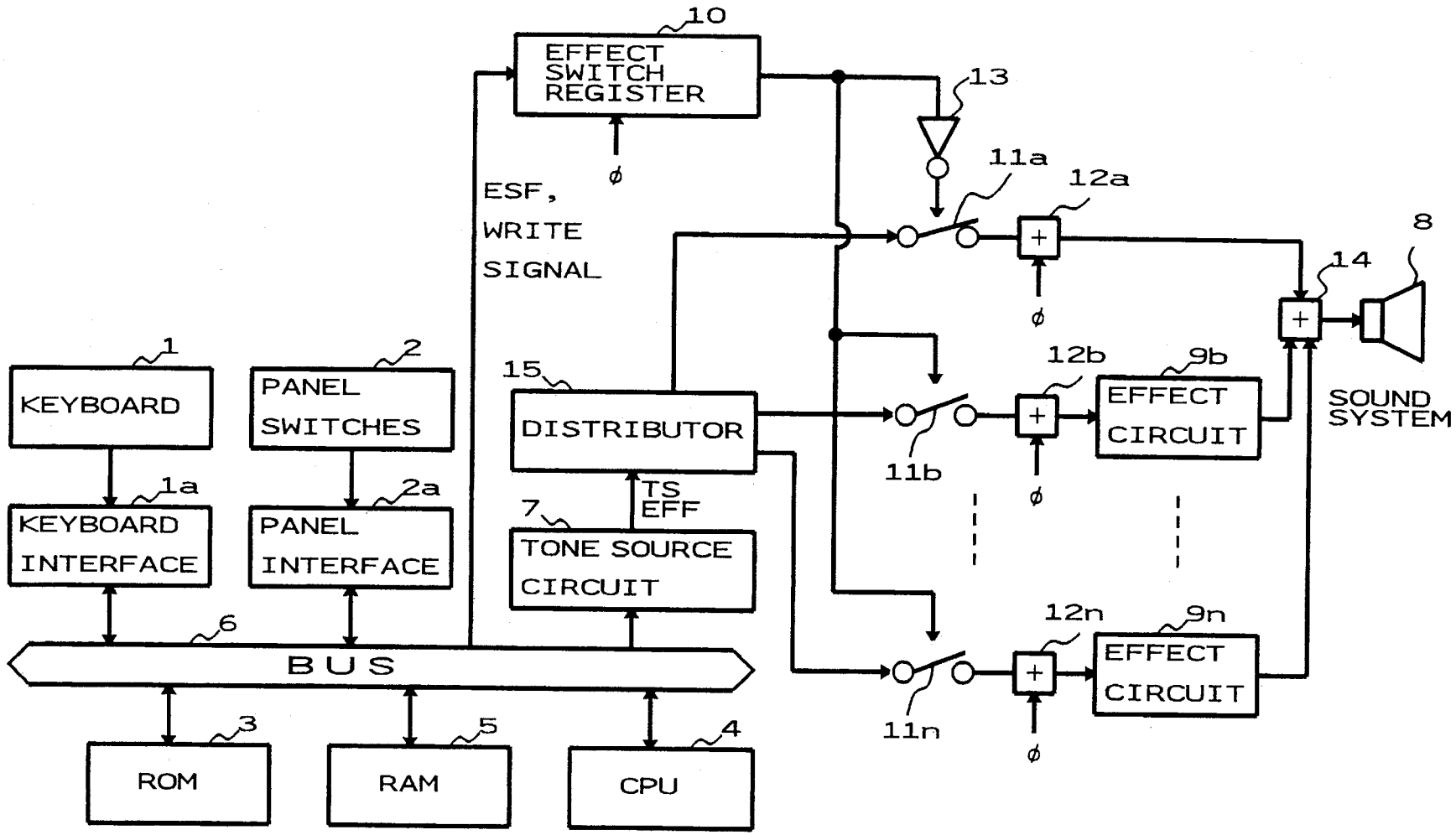
FIG. 15 is a block diagram of the entire construction of still another embodiment of an electronic musical instrument according to the invention.

FIG. 15 shows a modification of the embodiment of FIG. 10. This embodiment includes effect circuits **9*b*–9*n* for imparting different effects. Switches 11*b*–11*n* and accumulators 12*b*–12*n* in correspondence to the effect circuits 9*b*–9*n*. The respective switches 11*b*–11*n* are opened and closed in an interlocked manner with respect to one another and in opposite way to a switch 11*a*. In the same manner as in the third embodiment, these switches 11*b*–11*n* are closed when the output signal of a register 10** is "1" and opened when the output signal is "0".

A distributor 15 distributes a tone signal TS of each channel provided by a tone source circuit 7 to a line including no effect circuit and one or more lines including effect circuits **9*b*–9*n*. For controlling this distribution, effect data EFF is supplied from the tone source circuit 7. This effect data EFF designates, for each channel, which line a tone signal of the channel should be distributed to. The distribution control is made in such a manner that, in a certain channel, for example, a tone signal is distributed to a line including no effect circuit and a line including the effect circuit 9*b* and in another channel, a tone signal is distributed to a line including no effect circuit and lines including the effect circuits 9*b* and 9*n***.

This effect data EFF is determined in correspondence to a tone color identified by a tone color number TN. FIG. 16 shows an example of organization of tone color parameters corresponding to each tone color number TN. For a tone color of TN=1, for example, tones of a tone color of timber number TIM=1 and a tone color of timber number TIM=2 are generated and the tone signal having the tone color of the timber number TIM=1 is distributed to the line of the effect circuit **9*b* by effect data EFF=b, the tone signal having the tone color of the timber number TIM=2 is distributed to the line of the effect circuit 9*c* by effect data EFF=c. For a tone color of TN=2, a tone of the tone color of the timber number TIM=1 and the tone signal having the tone color of the timber number TIM=1 is distributed to two effect imparting lines of the effect circuits 9*b* and 9*c*** by effect data EFF=b and EFF=c. In this manner, a tone signal TS is distributed to one or more different effect imparting lines in accordance with a selected tone color (tone color number TN) whereby one or more different effects are impartd to a single tone.

As described in the foregoing, according to the electronic musical instrument of the invention, a tone imparted with an effect is generated when a key-on event in a keyboard is detected by key-on event detection means in a state in which the tone imparted with the effect is designated by operation means. Accordingly, even when a tone imparted with an effect is designated during generation of a tone which is not imparted with an effect, the tone which is currently being generated is generated continuously as a tone which is not imparted with the effect and a tone imparted with the effect is generated only upon a key-on event. The operability of the electronic musical instrument in imparting an effect during performance thereby is improved. Further, operation of the operation means during generation of a tone does not produce an unnatural change in the tone and generation of a noise due to panning, for example, can be prevented and an ensemble effect by key-on delay can be obtained.

What is claimed is:

1. An electronic musical instrument comprising:

tone generation instruction means for instructing that a tone should be generated;

tone color designation means for designating a tone color of the tone;

effect instruction means for instructing impartment of a predetermined effect to the tone independently of the tone color;

tone generation means for generating a tone having the tone color designated by said tone color designation means, said tone being imparted, or not imparted, with the predetermined effect with respect to the tone for which generation is instructed by the tone generation instruction means; and control means for controlling said tone generation means in such a manner that the predetermined effect is imparted only to a particular tone for which generation is instructed to start, after said effect instruction means has instructed that the predetermined effect should be imparted.

2. An electronic musical instrument as defined in claim 1 wherein said tone generation means comprises plural tone generation channels and said control means controls whether the predetermined effect should be imparted or not with respect to each of the channels.

3. An electronic musical instrument as defined in claim 2 wherein said tone generation means can set and control a tone color of a tone to be generated in each of the tone generation channels independently of the other channel.

4. An electronic musical instrument as defined in claim 2 wherein said tone generation means realizes, when a predetermined effect is to be imparted, the predetermined effect by assigning the tone to the plural tone generation channels so that the tone is generated with different characteristics in the plural tone generation channels.

5. An electronic musical instrument as defined in claim 1 which further comprises tone color selection means and wherein said tone generation means imparts an effect having a characteristic corresponding to a tone color selected by the tone color selection means.

6. An electronic musical instrument as defined in claim 5 wherein said tone generation means can impart one or more different effects to the tone color selected by the tone color selection means.

7. An electronic musical instrument as defined in claim 1 wherein said control means comprises memory means for storing an output signal of the effect instruction means and controls whether or not the predetermined effect should be imparted with respect to the tone in accordance with contents of the memory means at the time when start of tone generation has been instructed by the tone generation instruction means.

8. An electronic musical instrument as defined in claim 1 wherein said tone generation instruction means comprises keys for designating a tone and instructing generation of the tone.

9. An electronic musical instrument as defined in claim 1 wherein the predetermined effect is an ensemble effect and said tone generation means includes at least two tone generation lines which are designed to separately generate respective tone signals and realizes the ensemble effect by generating, with respect to the tone for which generation is instructed by the tone generation instruction means, tones in at least two lines in such a manner that the tones being generated in the respective channels start at different times.

10. An electronic musical instrument as defined in claim 1 wherein the predetermined effect is an ensemble effect and said tone generation means includes at least two tone generation lines which are designed to separately generate respective tone signals and realizes the ensemble effect by generating, with respect to the tone for which generation is instructed by the tone generation instruction means, tones in at least two lines with at least one of pitch, tone color and envelope being different from each other.

11. An electronic musical instrument as defined in claim 1 wherein the predetermined effect is an ensemble effect and said tone generation means includes at least two tone generation lines which are designed to separately generate respective tone signals and realizes the ensemble effect by generating, with respect to the tone for which generation is instructed by the tone generation instruction means, tones in at least two lines each being applied with a different panning control.

12. An electronic musical instrument as defined in claim 1 wherein the predetermined effect is one of reverberation, chorus, pitch change and delay effects.

13. An electronic musical instrument comprising:

tone generation instruction means for designating a tone and instructing that the tone should be generated;

effect selection means for selecting a predetermined effect;

tone generation means responsive to outputs of the tone generation instruction means and the effect selection means for generating a tone which is imparted, or not imparted, with the predetermined effect with respect to the tone designated by the tone generation instruction means depending upon whether an effect has been selected by the effect selection means or not; and control means for inhibiting, when an effect has been selected or the selection has been released by the effect selection means, a change of a tone being generated by the tone generation means to a state where the predetermined effect is imparted or to a state where the effect is released during generation of the tone.

14. An electronic musical instrument comprising:

tone generation instruction means for designating a tone and instructing that the tone should be generated;

effect selection means for selecting a predetermined effect;

means for deciding, when the tone designated by the tone generation instruction means is assigned to a tone generation channel, whether the predermined effect should be imparted to the tone or not depending upon whether an effect has been selected by the effect selection means or not; and tone generation means for assigning, in accordance with this decision, a tone which is imparted, or not imparted, with the predetermined effect with respect to the tone designated by the tone generation instruction means to a tone generation channel and generating, in accordance with this assignment, the tone which is imparted, or not imparted, with the predetermined effect in the tone generation channel.

15. An electronic musical instrument as defined in claim 14 wherein said tone generation means realizes, when a predetermined effect is to be imparted, the predetermined effect by assigning the designated tones to plural channels and generating the designated tone with different characteristics in the plural channels.

16. An electronic musical instrument as defined in claim 15 which further comprises tone color selection means and wherein said tone generation means assigns, when a predetermined effect is to be imparted, the designated tone to channels corresponding in number to tone colors selected by the tone color selection means.

17. An electronic musical instrument comprising:

tone generation instruction means for instructing that a tone should be generated;

effect instruction means for instructing to impart a predetermined effect to the tone;

tone generation means for generating tone signals in response to instructions by said tone generation instruction means;

effect imparting means for imparting the predetermined effect to tone signals generated from said tone generation means; and control means for controlling said effect imparting means in such a manner that the predetermined effect is imparted only to a particular tone signal corresponding to a tone for which start of generation is instructed by said tone generation instruction means after instruction by said effect instruction means that the predetermined effect should be imparted.

* * * * *